United States Patent [19]

Brackmann et al.

[11] 4,005,717

[45] Feb. 1, 1977

[54] TOBACCO STREAM MANUFACTURE

[75] Inventors: Warren A. Brackmann, Cooksville; Daniel DiIanni, Toronto, both of Canada

[73] Assignee: Rothmans of Pall Mall Canada Limited, Toronto, Canada

[22] Filed: Dec. 22, 1975

[21] Appl. No.: 643,100

Related U.S. Application Data

[63] Continuation of Ser. No. 384,914, Aug. 2, 1973, abandoned, which is a continuation of Ser. No. 176,109, Aug. 30, 1971, abandoned, which is a continuation-in-part of Ser. No. 128,412, March 26, 1971, abandoned.

[52] U.S. Cl. ..... 131/84 R; 131/109 R; 131/110

[51] Int. Cl.[2] ..... A24C 5/18

[58] Field of Search ..... 131/84 B, 84 R, 84 A, 131/84 C, 61 B, 109 R, 110, 109 B

[56] References Cited

UNITED STATES PATENTS

| | | | |
|---|---|---|---|
| 2,169,582 | 8/1939 | Dearsley et al. | 131/84 A |
| 2,676,694 | 4/1954 | Wyss et al. | 131/109 R X |
| 2,766,758 | 10/1956 | Molins et al. | 131/84 A |
| 2,841,154 | 7/1958 | Dearsley | 131/109 R |
| 3,034,514 | 5/1962 | Pinkham | 131/110 X |
| 3,036,578 | 5/1962 | Molins | 131/84 B X |
| 3,196,880 | 7/1965 | Pinkham | 131/84 R |

FOREIGN PATENTS OR APPLICATIONS

| | | | |
|---|---|---|---|
| 266,385 | 10/1913 | Germany | 131/109 B |
| 1,068,663 | 5/1967 | United Kingdom | 131/84 B |
| 979,886 | 1/1965 | United Kingdom | 131/110 |
| 986,640 | 3/1965 | United Kingdom | 131/84 C |
| 813,576 | 5/1959 | United Kingdom | 131/61 B |

*Primary Examiner*—Stephen C. Pellegrino
*Attorney, Agent, or Firm*—Sim & McBurney

[57] ABSTRACT

A tobacco filler rod having an increased filling power or selected areas of increased quantity of tobacco in the cross section of the rod is formed from a broad stream of tobacco particles.

2 Claims, 1 Drawing Figure

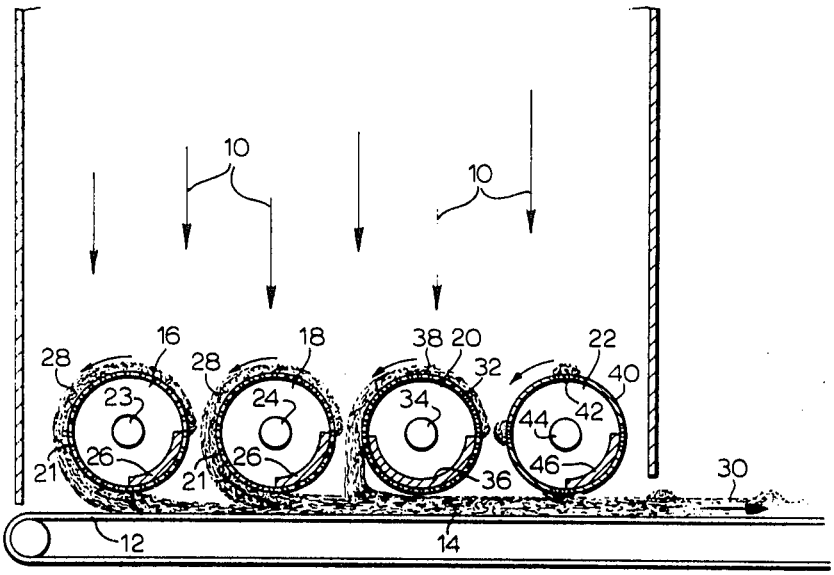
INVENTOR.
WARREN A. BRACKMANN
DANIEL DiIANNI
BY
Lin ell & Burney

TOBACCO STREAM MANUFACTURE

This is a continuation of application Ser. No. 384,914 filed Aug. 2, 1973, now abandoned, which itself is a continuation of application Ser. No. 176,109 filed Aug. 30, 1971, now abandoned, which is a continuation in part of application Ser. No. 128,412 filed March 26, 1971, now abandoned.

This invention relates to the formation of a tobacco rod for use as a filler for cigarettes.

In the conventional formation of tobacco filler rods, a relatively broad stream of tobacco particles of varying sizes, usually approximately 36 inches wide, first is provided. This stream usually is rendered as even as possible by various means. The broad stream is thin and is gathered together in suitable manner to form a narrow stream of tobacco particles which is built up along its length by particles from the broad stream to form a continuous tobacco rod. Cigarettes are formed from the rod usually by lateral compression, followed by wrapping in paper, after which individual cigarettes are cut from the continuous cigarette rod.

Typically the broad stream of tobacco particles is gathered to form the narrow tobacco rod by allowing the broad stream to fall onto a narrow belt moving substantially perpendicularly to the direction of movement of the broad stream. The belt may have a substantially flat gathering surface. Alternatively, the belt may have a trough-like form.

To reduce the tendency of tobacco particles to be displaced longitudinally of the narrow stream in a direction opposite to the direction of movement of the narrow belt, thereby forming knots or balls of particles in the forming narrow stream, it has become common practice to construct the narrow belt of airpermeable material and to apply a gentle vacuum through the surface. This use of a gentle vacuum has been throught to grip the tobacco particles to the surface of the belt upon contact thereby diminishing the tendency of the narrow stream to ball up. This effect may be true for thin layers of tobacco on the belt, but as the layers become thicker the effectiveness of the vacuum diminishes.

Close examination by high speed photography of the gathering of the falling broad stream into a narrow stream of tobacco particles has revealed that, while the gentle vacuum is to a certain degree effective in preventing displacement of the particles in those portions of the conveyor where the narrow stream is relatively thin, in thicker portions considerable peaks and valleys of tobacco particles in the forming stream occur as the vacuum loses its effectiveness on the particles remote from the surface. The tobacco rod therefore lacks uniformity of quantity of tobacco in the cross section thereof. This may give rise to unsatisfactory finished products.

It was also observed that there was a marked tendency for longer tobacco particles to be aligned axially in the tobacco rod. The filling power of a cigarette filler rod is important to the economics of cigarette manufacture and axial alignment of longer tobacco particles provides a tobacco rod. which does not have as high filling power as one in which at least a proportion of the longer tobacco particles are radially aligned.

The above-mentioned close examination additionally indicated that smaller particles tend to penetrate the surface of the portions of the stream already present on the conveyor belt while larger particles lie on the surface. In effect there is a classification of tobacco particle sizes over the cross section of the rod, with smaller particles tending to be located closer to the conveyor belt and larger particles tending to be located remote from the belt.

One effect of this classification is that bad ends to the cigarettes may result, together with uneven burning rates and uneven burning temperatures, with accompanying effects on smoke constituents and taste.

Because of the lack of uniformity of the quantity of tobacco in the cross section of the rod, it is common practice to provide the rod having peaks which contain more tobacco than is required in the final cigarette and to trim the excess tobacco, generally about 20% of the total tobacco in the rod, from the rod. It often is desirable to form cigarettes having a higher density of tobacco at the ends than elsewhere. A number of methods have been practised and suggested to provide such denser ends, generally associated with the trimming operation.

In addition to the formation of a tobacco rod from a falling broad stream of tobacco particles, tobacco rods are formed from broad streams of particles which are projected upwardly in a tunnel by air flow. The particles are gathered on the underside of an air-permeable, tobacco-impermeable belt moving transverse to the direction of movement of the broad stream. The tobacco particles are held on the under-surface of the belt by suction through the belt.

The present invention is applicable to both the formation of tobacco rods from downwardly flowing and upwardly flowing broad streams of tobacco particles.

In accordance with one aspect of the present invention, a plurality of narrow substreams of tobacco particles are formed from the broad stream and the narrow stream is assembled from the substreams to provide a tobacco rod having increased filling power.

In accordance with a second aspect of the present invention, the narrow substreams are assembled to provide a tobacco rod having spaced apart areas of increased tobacco quantity in the cross section.

In addition, in accordance with a third aspect of the present invention, the narrow substreams are assembled to provide a tobacco rod and at least one of the substreams is utilized to selectively increase the quantity of tobacco in the rod.

By controlling the form of the narrow substreams and by controlling the manner of assembly of the narrow stream from the substreams, an improved tobacco filler rod having controlled characteristics is provided.

A rod may be provided in which classification of the tobacco particles is substantially eliminated. Thus, there is a substantially uniform distribution of particles over the cross section of the tobacco rod. An additional improvement is that there may be formed a rod having a substantial absence of the peaks and valleys associated with the conventionally formed rod. Thus, there is a substantially uniform quantity of tobacco in the cross section of the rod.

The provision of a narrow stream having a substantially uniform quantity of tobacco in the cross section of the rod and a substantially uniform distribution of tobacco particles over the cross section of the rod formed from a falling broad stream is the subject of copending application Ser. No. 384,916, filed Aug. 2, 1973, now U.S. Pat. No. 3,989,052.

It is possible by the present invention to provide a tobacco filler rod having a greater filling power due to an improved orientation of tobacco particles.

The present invention in another aspect allows the provision of dense ends in a finished cigarette without the necessity of trimming the rod. Further, in those cases where minor inconsistencies occur in the quantity of tobacco in the cross section of the rod in the form of shallow depressions, these minor inconsistencies may be corrected by adding tobacco from the substreams.

The present invention is described further by way of illustration with reference to the accompanying drawing, which is a schematic representation of a control device in accordance with the present invention.

A broad stream of tobacco particles of varying particle sizes 10, formed in any convenient manner, falls under the influence of gravity and/or air flow towards a conveyor 12 the top surface of which constitutes a forming surface or zone for a narrow stream of tobacco 14. As illustrated, the conveyor 12 is positioned to move substantially transverse to the direction of motion of the broad stream of particles 10. The conveyor belt 12 may move at a speed substantially in excess of the speed of the falling particles.

The falling stream 10 may be provided in any convenient manner, and generally has a uniform quantity of tobacco across its width. For example, a shower of tobacco particles may be sprayed onto the top surface of a conveyor belt to form on the belt a broad stream of tobacco particles. This broad stream is conveyed on the belt to the end thereof, at which point the particles fall off the conveyor and form the falling stream or curtain 10.

A plurality of control wheels or discs 16, 18, 20 and 22 are positioned in the path of the broad stream 10 and adjacent the gathering surface of the conveyor 12. The control wheels in the embodiment illustrated each are positioned in a single plane to rotate in an anti-clockwise direction on horizontal axes which are parallel to each other and transverse to the plane in which the broad stream 10 is located. Additionally, the wheels are located with their axes of rotation located in a plane parallel to the plane of the conveyor top surface. It is not essential to provide the horizontal axes in the plane parallel to the plane of the top surface of the conveyor 12. It is possible to stagger the locations of the wheels from this configuration.

While the wheels are illustrated with their axes transverse to the plane of the stream, it is possible to provide the wheels with their axes positioned angularly with respect to the plane.

The purpose of the wheels is to form a plurality of substreams from the falling broad stream 10. While wheels having a particular construction are illustrated to accomplish this, it is within the scope of the invention to provide any convenient gathering means to form a plurality of substreams.

The wheels 16 and 18 are identical. Each wheel 16 and 18 is in the form of a cylinder having closed top and bottom faces and an air-permeable tobacco impermeable wall 21 between the faces, which constitutes a narrow substream-forming surface. The porous wall or peripheral surface 21 is positioned in the path of the stream 10 and rotates in the plane of the stream. A vaccum is applied to the interior of the wheels such as by vacuum-inducing means header pipes 23 and 24 passing through one face of the wheels 16 and 18 so that a considerable suction is applied through the surface 21. Inside each of wheels 16 and 18 and located adjacent the inside surface of the wheel is a non-porous fixed shield or shoe 26. The shoe 26 may be constructed in any convenient manner so that the suction is released over those portions of the surface 21 adjacent thereto at any given time. The shields 26 are illustrated as located within the wheels 16 and 18 so that the vacuum is prevented from acting over the area of the surface 21 of the wheel which is located from approximately the point of nearest approach of the wheel to the top surface of the conveyor 12 through about 90° in the direction of movement of the wheel. Such a construction of wheels and the construction of wheels 20 and 22 described below forms the subject matter of copending application Ser. No. 177,740, filed Sept. 3, 1971, now U.S. Pat. No. 3,779,252.

As the particles in the stream 10 fall towards the gathering zone, they are arrested by the suction acting over the porous surface 21 when vacuum is induced within the wheel and are gripped on the surface 21. A narrow and thin substream of tobacco particles 28 builds up on each of the surfaces 21 as the wheels 16 and 18 rotate anti-clockwise, the narrow substream having increasing depth in the direction of movement of the wheels. Since the substreams formed on the porous surface 21 are relatively thin, the vacuum applied thereto maintains the particles on the surfaces and no balling up occurs. Preferably, wheels 16 and 18 rotate at the same speed but it is possible to provide different speeds of rotation, if desired.

As the wheels rotate, the speed of the tobacco particles is increased to close to the speed of the conveyor, so that the differential speed between the tobacco particles in the substreams on wheels 16 and 18 and the conveyor 12 is low, providing the speeds of rotation of the wheels 16 and 18 and the linear speed of the conveyor 12 are approximately equal.

When the narrow substream 28 on wheel 16 reaches the shield 26 associated with that wheel, the substream no longer is held by the vacuum and therefore the particles of the substream fall from the surface 21 onto the top surface of the conveyor 12. Generally, the wheels 16 and 18 are positioned close to the conveyor 12, so that the substream 28 is laid gently on the top surface of the conveyor 12, thereby avoiding disturbance of the relative locations of the tobacco particles in the substream 28. As the conveyor generally is moving with considerable speed to the right as seen in the figure, then a degree of displacement of the substream occurs in the direction of movement of the conveyor surface as it is deposited on the surface, as illustrated.

Similarly, when the narrow substream 28 on wheel 18 reaches the shield 26 associated with that wheel, then the narrow substream of tobacco particles is laid gently on top of the existing stream which was laid from the wheel 16. The wheels may rotate at any convenient speed relative to the speed of the top surface of the conveyor 12. Generally, the speed of rotation of the wheels 16 and 18 and linear speed of the conveyor belt 12 are substantially the same so that there is little or no relative speed between the tobacco particles in the substreams 28 and the conveyor when the particles are laid on the conveyor surface.

The rotational speed of the wheels and the linear speed of the conveyor however may vary from each other so that the substream of tobacco particles is lengthened or shortened on the conveyor belt relative to its length on the surface 21, as desired. If the top surface of the conveyor 12 moves faster than the rotational speed of the wheels, then the substreams 28 are stretched, whereas if the top surface of the conveyor 12 moves slower than the rotational speed of the wheels, then the substreams 28 are abbreviated.

The speed of rotation of wheels 16 and 18 is dependent on the quantity of tobacco desired in the narrow substreams 28 formed on the surface thereof. At lower speeds of rotation, larger quantities of tobacco are deposited on the surfaces 21 and, therefore, the substreams placed on the conveyor 12 are thicker, whereas at higher speeds of rotation lower quantities of tobacco are deposited on the surfaces 21 and the substreams placed on the conveyor are thinner. The degree of vacuum applied over the inner surface of the wheels also may be varied as required.

Due to the control of the velocity of the approach of the tobacco particles from the falling broad stream to the conveyor 12 by the formation of substreams, a number of improvements result. For example, there is no penetration between the tobacco particles of one narrow substream 28 as it is positioned on another as the stream 14 is made up on the conveyor. As compared to a tabacco stream formed in conventional manner from a falling broad stream, there is provided a tobacco rod 30 having a more uniform distribution of tobacco particle sizes over its cross section. Additionally, the tendency of the particles to form peaks and valleys is considerably diminished so that, as compared to a conventionally formed rod, the present invention provides a tobacco filler rod having a more uniform distribution of quantity of tobacco over its cross section.

The formation of substreams from the falling broad stream 10 and the subsequent formation of a combined narrow stream on the top surface of the conveyor 12 has been illustrated utilizing two wheels, so that the tendencies of classification of the particles and the formation of peaks and valleys are reduced. This manner of illustration is a matter of convenience and it is preferred to employ more than two such wheels. The actual number of wheels of the type 16 used depends on a number of factors, including the characteristics desired in the finished rod, the width of the broad stream 10 and the distance between the top surface of the conveyor and the source of the broad stream 10.

As the narrow substreams 28 are formed on the porous surfaces 21 of the wheels a minor degree of classification and peak-and-valley formation may occur on each wheel. If a plurality of wheels is provided and a narrow substream of small ultimate depth is formed on each such wheel and the narrow stream 14 is formed from the plurality of narrow substreams, then the stream 14 in effect is formed of a plurality of layers of tobacco particles. The final rod 30 formed in this manner has a substantially uniform quantity of tobacco in the cross section thereof, and additionally has a substantially uniform distribution of particle sizes over the cross section. This rod, therefore, represents a considerable improvement over the rod obtained by conventional means.

The wheels of the type 16,18 are spaced from the top surface of the conveyor 12 any desired distance. As indicated above, generally the distance is such that the substreams are gently laid one on top of the other. In certain circumstances, it may be desirable to compress the narrow substream as it is placed on the surface by spacing the wheel less than the thickness of the substream away from the already partially formed stream 14.

Wheel 20 is of similar construction to wheels 16 and 18 and is provided with an air-permeable tobacco impermeable peripheral wall or surface 32 in similar manner to wheels 16 and 18. A vacuum is applied to the interior of the wheel, such as by vacuum inducing means header pipe 34 passing through one face of the wheel to provide a suction through the porous surface 32. Inside the wheel 20 and located adjacent the inside surface thereof is a non-porous fixed shield or shoe 36 which has a semi-circular cross section. The shield 36 extends approximately from the ends of the diameter of the wheel 20 parallel to the conveyor 12 through the lower half of the wheel. As in the case of shoe 26, shoe 36 may be constructed in any convenient manner so that the suction is released over the semi-circular portion of the surface 32 adjacent the shoe at any particular time.

Tobacco particles from the falling stream 10 are captured by the surface 32 and form a narrow substream 38 of tobacco particles on the surface 32 of increasing depth in the direction of rotation of the wheel 20. As mentioned above in connection with the conventionally-formed narrow stream, the longer strands of tobacco tend to be oriented generally in the direction of the narrow substream 38.

The wheel 20 rotates at a fast speed relative to the rate of flow of the broad stream 10 and generally at approximately the speed of the conveyor 12. The relative speeds of the wheel 20 and the conveyor 12 may be varied as desired.

As the wheel 20 rotates anti-clockwise, tobacco particles are projected from the substream 38 at the shield 36 towards the narrow stream 14. Some of the longer particles in this way become buried radially in the stream 14.

By the provision of some radially-oriented tobacco particles in the narrow stream 14, there is obtained in accordance with one aspect of the present invention a rod having a greater filling power than conventionally formed filler rods. A single wheel of the type 20 is illustrated. It may be desired, in this aspect of the invention, under certain circumstances, to use more than one wheel of this type, in conjunction with or in the absence of, wheels of the type 16,18. While this aspect of the invention has been described with reference to a falling broad stream of tobacco particles, as indicated above, the invention also is applicable to the formation of radially aligned tobacco shreds in a narrow stream formed from a broad stream moving upwardly in an air flow, the narrow stream being formed on the underside of a belt.

Wheel 22 is of similar construction to wheels 16 and 18, including a cylinder having closed top and bottom faces and a partially porous wall or surface 40. The surface 40 is provided with porous portions 42 which are positioned at spaced intervals around the periphery. The porous portions may be provided at any convenient intervals, typically at 90° to each other. Vacuum is applied to the interior of the wheel 22 by vacuum header pipe 44 passing through one of the faces, thereby producing a suction through the porous portions 42 of the surface 40.

Located inside the wheel 22 is a non-porous fixed shield or shoe 46, which extends from approximately the closest point of approach of the surface 40 to the top surface of the conveyor 12 through 90° in the direction of movement of the wheel 22. The shoe 46 may be of any convenient form to release the suction applied through those portions of the porous surface 42 from time to time adjacent thereto.

As the stream of particles 10 falls towards the surface 40, some of the particles are arrested by the action of the vacuum on the porous areas 42 thereby forming a plurality of spaced-apart substreams 48 on the surface 40.

When one of the porous portions 42 of the wheel 22 has rotated to reach the shield 46, the particular substream adjacent the shield is deposited on the stream 14, thereby providing areas of increased cross-sectional quantity along the stream 14. These areas of increased quantity in the cross section are the basis for dense ends in the final cigarette. During the later manufacturing steps to form the cigarettes, the rod 30 is compressed to form a rod of uniform diameter, but due to the presence of larger quantities of tobacco at selected spaced-apart positions along the length of the rod, the uniform diameter rod formed after compression has spaced-apart denser areas, which are positioned equivalent to one or both ends of cigarettes formed from the rod. It will be seen, therefore, that the present invention is able to achieve dense ends without the necessity for complicated trimming techniques.

The speed of rotation of wheel 22 and the number of openings 42 in the surface 40 may be controlled to provide for depositing the required number of substreams 48 at the required locations equivalents to the one or two lumps of tobacco to be located at spaced-apart locations on the rod 30.

Where a wheel of the type 22 is employed in accordance with the second and third aspects of this invention, only one usually is required, although it is possible to provide more than one such wheel, if desired. Such wheel 22 may be used in combination with a plurality of the wheels of the type 16, with or without the presence of one or more wheels of the type 20.

This aspect has been described particularly with reference to the formation of the rod from a broad falling stream of tobacco particles. However, as indicated above, dense ends may be provided on tobacco rods, in accordance with this aspect of the invention, which are formed from an upwardly flowing broad stream of tobacco in an air flow.

It is possible that the stream 14 formed from the substreams 28 may have valleys therein, so that the quantity of tobacco in the cross section of the assembled rod 30 is not uniform. By the provision of a wheel of the type 22 with a movable vacuum shoe and a detector means upstream of this wheel it is possible to detect the locations of such valleys and fill them in with the substream on this wheel by selective application of the vacuum shoe. In this way any imperfections in the consistency of the quantity of tobacco in the cross section of the rod 30 may be corrected.

Excess tobacco on the wheel 22, not used for filling in gaps, may be recovered from the wheel 22 and returned to the hopper of tobacco which serves as the source from which the broad stream is formed.

The apparatus described above with reference to the drawing may be varied to achieve different functions. The particular functions chosen are suited to local requirements and depend on a number of factors, such as tobacco costs, type of tobacco and the nature of the market.

The relative locations of the different types of wheels may be varied if desired. Additionally, the wheels may be provided in overlapping relationship if desired.

Additionally, a plurality of auxiliary tobacco directors may be provided located above the wheels 16, 18, 20 and 22, such as additional wheels, to direct tobacco particles as desired towards the wheels.

The wheels may be spaced apart as desired so that any given quantity of tobacco may fall directly onto the conveyor 12 without being subjected to manipulation by the wheels.

It is not necessary to provide a flow of tobacco particles in the stream 10 which is evenly distributed over its width. By maintaining a substantially fixed configuration of flow it is possible to maintain a consistent end product rod 30 by appropriate use of the substreams.

Further, the vacuum may be provided over differing portions of the surfaces of the wheels from that illustrated and described above. For example, the shield 36 associated with wheel 20 may be extended further in the clockwise direction, terminating at an approximately 11 o'clock position, so that the narrow substream 38 is thrown onto substream 28. If desired, a similar arrangement may be provided with wheel 18 so that tobacco particles are transferred from wheel 20 to wheel 18 and thence to wheel 16. This arrangement reduces classification and the formation of peaks and valleys of the tobacco particles and the three layers thereby provided on wheel 16 are gently deposited on the top surface of the conveyor 12.

Further, it is not necessary that the shoes located within the wheels extend throughout the arcuate distance indicated. It is possible to provide the vacuum cut-off point at any convenient position, for example, in wheels 16, 18 and 22 for deposition of the tobacco onto the conveyor or onto tobacco already deposited on the conveyor. Further, the vacuum shoe may extend any desired arcuate distance from the cut-off point, varying as desired from the approximately 90° for wheels 16, 18 and 22 and the approximately 180° for wheel 20.

It will be seen, therefore, that the present invention provides methods which manufacture an improved tobacco filler rod. In view of the improvements in the characteristics of the tobacco filler rod formed in the present invention as compared to the rod formed by conventional means, cigarettes may be produced having a more consistent and improved quality.

The above-described specific embodiment of the invention represents only one example of the manner in which control of the formation of the narrow tobacco stream may be achieved to suit individual requirements. Other manners of achieving this control are possible and many modifications are possible within the scope of this invention.

What we claim is:

1. A process for forming a narrow tobacco filler rod having longitudinally spaced-apart zones of increased quantity of tobacco in the cross section of the filler rod to provide dense ends in cigarettes ultimately formed from the filler rod, which comprises:

showering a relatively wide broad stream of tobacco particles of narrow thickness substantially in a plane onto a plurality of continuously moving arcuate suction surfaces located in said plane across the width of said broad stream, continuously moving each of said continuously moving surfaces in said plane between a first position in which said surfaces move transverse to said broad stream and contact and intercept particles of said broad stream and a second position in which said surfaces are out of contact with particles of said broad stream;

applying suction through each of said surfaces while located in said first position to attract tobacco particles from said broad stream onto said surfaces and grip said attracted particles thereto whereby said attracted particles assume the speed of said moving surfaces to form directly from said broad stream one tobacco substream constituted by discrete discontinuous clusters of tobacco particles and a plurality of narrow elongate tobacco substreams containing substantially the same quantity of tobacco and extending the length of the portion of each of said continuously moving surfaces located in said first position;

transporting the tobacco particles in each of said substreams on said continuously moving surfaces under the influence of suction grip by said continuous movement of said surfaces to said second position;

moving a tobacco stream-receiving and filler rod-forming surface transversely to and within the plane of said broad stream adjacent said continuously moving surfaces in their second position;

releasing said suction grip on the particles of each of said plurality of substreams from the respective continuously moving surface when said respective continuously moving surface is in said second position, said particles of said plurality of substreams are moving in substantially the same direction as and adjacent to said receiving surface, and said particles of said plurality of substreams are moving at substantially the same speed as said receiving surface;

depositing said particles of said plurality of substreams immediately after said release from said moving surfaces onto said receiving surface or onto tobacco already deposited thereon while maintaining said deposited tobacco particles in substantially the same positions with respect to one another as existed in the transported plurality of substreams whereby each of the transported substreams is released from the respective continuously moving surface and is coherently positioned on the receiving surface or on tobacco already positioned thereon to provide a filler stream constituted substantially by superimposed coherent layers of tobacco in which each layer corresponds to one of said plurality of substreams;

successively releasing said suction grip on ones of said discrete cluster substreams at predetermined intervals of time;

depositing said released discrete cluster substream immediately after said release thereof substantially in coherent form onto said receiving surface or onto tobacco already deposited thereon from said plurality of continuous substreams immediately after release from the respective continuously moving surface to provide predeterminedly longitudinally spaced apart zones of increased quantity of tobacco in the cross section of the filler rod; and removing a tobacco filler rod from said receiving surface.

2. The process of claim 1 including providing said discrete clusters of tobacco particles as the substream located closest to the removal of said filler rod from said receiving surface.

* * * * *